US005599163A

United States Patent [19]

Heath et al.

[11] Patent Number: 5,599,163

[45] Date of Patent: Feb. 4, 1997

[54] REGENERATIVE PUMP HAVING MOVABLE WALLS ADJACENT OPPOSING FACES OF THE IMPELLER

[75] Inventors: Ronald A. Heath, Warley; Thomas Llewellyn-Jones, Gloucester; Brian Robins, Solihull; Trevor S. Smith, Sutton Coldfield, all of United Kingdom

[73] Assignee: Lucas Industries PLC, Solihull, United Kingdom

[21] Appl. No.: 540,672

[22] Filed: Oct. 11, 1995

[30] Foreign Application Priority Data

Oct. 13, 1994 [GB] United Kingdom ..... 9420653
Apr. 28, 1995 [GB] United Kingdom ..... 9508638

[51] Int. Cl.[6] ..... F04D 5/00

[52] U.S. Cl. ..... 415/55.1; 415/55.2

[58] Field of Search ..... 415/55.1, 55.2, 415/55.3, 55.4, 53.3

[56] References Cited

U.S. PATENT DOCUMENTS

| | | | |
|---|---|---|---|
| 3,257,955 | 6/1966 | Worst | 415/55.4 |
| 3,405,644 | 10/1968 | Skinner | 415/55.2 |
| 4,194,360 | 3/1980 | Stieger | 415/55.2 |
| 5,299,908 | 4/1994 | Robbie | 415/55.2 |

FOREIGN PATENT DOCUMENTS

| | | | |
|---|---|---|---|
| 1016885 | 10/1957 | Germany | 415/55.1 |
| 1112688 | 4/1968 | United Kingdom . | |
| 1145281 | 3/1969 | United Kingdom . | |
| 2237067 | 4/1991 | United Kingdom . | |
| 2253010 | 8/1992 | United Kingdom . | |
| 2260368 | 4/1993 | United Kingdom . | |

*Primary Examiner*—Edward K. Look
*Assistant Examiner*—Mark Sgantzos
*Attorney, Agent, or Firm*—Marshall, O'Toole, Gerstein, Murray & Borun

[57] ABSTRACT

A regenerative pump is provided in which an impeller is centrally located within a cavity and variable volume side channels are provided such that the pump characteristic can be varied. A control mechanism is provided for controlling the volume of each side channel in a symmetrical manner.

16 Claims, 6 Drawing Sheets

REGENERATIVE PUMP HAVING MOVABLE WALLS ADJACENT OPPOSING FACES OF THE IMPELLER

TECHNICAL FIELD

The present invention relates to a regenerative pump having a variable output characteristic.

Regenerative pumps comprise a housing with a fluid inlet and a fluid outlet, and an impeller rotatably mounted within the housing and having a plurality of vanes spaced angularly around the impeller axis within a flow channel that extends through the housing between the inlet and outlet. When the impeller is rotated, the vanes induce centrifugal effects in the fluid which cause it to be re-circulated repeatedly in the flow channel across the vanes, thereby progressively increasing pressure as it flows in a spiral or helical path between the inlet and outlet. A stripper block is located between the inlet and outlet and has sufficient clearance with the impeller and vanes to allow them to pass but to restrict direct fluid flow from the higher pressure fluid outlet to the lower pressure fluid inlet. The flow channel may comprise a side channel on one or both sides of the channel as in GB 2253010, or a channel about an annular core around the periphery of the impeller as in GB 2260368.

Regenerative pumps are mechanically simple and reliable and are capable of operating at high speed and have low specific weight. Regenerative pumps are also capable of generating high pressures and high flows, the pressure generally being proportional to the square of the impeller speed, and the flow generally being proportional to the impeller speed. Such pumps have already been produced as backing or boost pumps for aviation gas turbine engines. However, in some applications, particularly as engine driven main fuel pumps for aviation gas turbine engines, this pressure/flow speed characteristic can be a problem under some operating conditions. Thus a regenerative fuel pump may be designed to produce the required fuel pressure and flow at high engine speed and flow conditions. However, at low engine power conditions, particularly during descent, where the engine speed may be 60%–90% of rated speed, and the required fuel flow may be of the order of 1/50 of rated flow, excessive pump input power may lead to unacceptable heat rejection.

It has been proposed in the prior art to overcome these problems by providing means to blank-off portions of the side channels so as to prevent re-circulation of fuel therein, thereby reducing the pressure rise and fuel heating. In GB 1112688, a pair of arcuate blanking plates are pivotally mounted in the housing assembly about a common axis so that they can be swung together between the vanes and the side channels on opposite sides of the impeller to partially close the side channels along their circumferential length. The remaining open areas of the side channels then effectively taper from the inlet to the outlet. In GB 2237067, a pair of blanking plates are slidably mounted in the housing assembly on opposite sides of the impeller and are formed with arcuate slots which can be fully or partially aligned with the side channels depending on the lateral position of the blanking plates. However, in both of these prior art pumps, the power input is still significant, causing fuel heating.

GB1145281 discloses a regenerative pump having an impeller having blades on one side thereof rotatably mounted within a cavity in a housing. The cavity opens into an annular recess which has a piston movable therein so as to vary the volume of the annular recess.

DISCLOSURE OF THE INVENTION

According to the present invention, there is provided a regenerative pump comprising a housing with a fluid inlet and fluid outlet, an impeller rotatably mounted within a cavity within the housing and having a plurality of vanes spaced angularly around the impeller axis and opening into a channel formed in the housing to extend between the inlet and outlet, and a stripper block located between the inlet and outlet to restrict direct flow of fluid between the outlet and inlet, characterised in that the impeller is located in a central portion of the cavity, and first and second filler members are provided adjacent opposing faces of the impeller and are movable within the channel so as to vary the cross-section of the channel as measured in a first plane containing the axis of rotation of the impeller.

It is thus possible to provide a regenerative pump in which the aforesaid problem of excess pressure and/or excess flow at low engine power conditions, can be reduced or overcome by varying the displacement of the pump.

The channel may be formed of two side channels which are located on either side of the impeller but which deliver fluid to a common pump output. The side channels may also receive fluid from a common input. Thus the channel is effectively formed from two side channels which are substantially isolated from each other within the cavity but which deliver fluid to a common fluid flow path.

The pump input power depends on the pressure rise and pump displacement. Under conditions of reduced flow demand, the filler members are moved to reduce the cross-section of the channel, which in turn reduces the displacement of the pump, and thereby the pump input power. Excess pump input power and fuel heating is therefore reduced.

In a preferred embodiment of the invention, the filler members extend the full length of each channel and are moved to vary the cross-section of the channels in a uniform manner throughout their lengths. For example, each filler member may constitute a wall of each channel and may be moved axially relative to the radial plane of the impeller to vary the axial depth of the associated channel. Alternatively, a filler member may constitute a side wall of the channel and may be moved radially to vary the radial width of the channel.

Preferably, the impeller exhibits reflection symmetry about a second plane perpendicular to the axis of rotation (i.e. the axis of rotation defines a normal to the second plane). The blades may be profiled so as to define chevrons with the chevron pointing away from the direction of rotation of the impeller.

Preferably, the pump further comprises actuators for moving the first and second filler members in accordance with the required pump characterised or output.

Advantageously, a fluid operated control mechanism is provided which controls the actuators so as to position the filler members at the required positions.

Each actuator may comprise a variable volume chamber defined in part by a rear surface of the respective filler member. Alternatively, the actuators may comprise piston and cylinder arrangements which are connected to, or integral parts of, the filler members. Thus, fluid may be admitted into or removed from the actuators in order to control the positions of the filler members.

Fluid pressure to the actuators may be provided via respective first and second flow restrictors connected in series between a high pressure fluid supply and a low pressure fluid source/sink. The low pressure fluid source/sink may be a low pressure return line. One of the flow restrictors may be at least one fixed orifice and the other flow restrictor may be at least one variable orifice whose venting may be controlled in order to control a servo pressure derived from a position intermediate the first and second flow restrictors. The servo pressure is supplied to the respective actuators.

Thus, in one embodiment of the present invention the regenerative pump has a fluid-operated servo-control mechanism to control the axial position of the wall that determine the depths of the side channels, the mechanism comprising two controllers, each controller comprising a fluid chamber communicating with the rear of the wall so that axial movement of the respective wall is controlled by fluid pressures acting on opposite sides of the wall, a fluid flow restrictor connected between the outlet of the pump channel and said chamber, and a servo-control valve which controls venting of fluid from said chamber according to the difference in setting of an input control actuator and the depth of said channel as measured by a mechanical feedback connection from the wall, the control of the degree of venting from said chamber by said controller being such that the depth of said channel follows the position of the input control actuator.

Preferably, the mechanism controls the depth of two side channels on each side of the impeller simultaneously in a symmetrical manner.

In an alternative arrangement, both the first and second flow restrictors may comprise variable orifices arranged such that motion of a control element to open one orifice causes the other orifice to close. As used in this context, the term open refers to an increase in venting of an orifice, and the term close refers to a decrease in venting of an orifice.

The orifices of the first and second flow restrictors may cooperate with a common spool which has tapered channels formed in the surface thereof such that relative rotation or axial movement of the spool with respect to orifices varies the servo pressure.

The control mechanisms for each of the actuators may be ganged together such that each mechanism (controller) receives a common input but is able to independently execute closed loop control of its respective actuator. The orifices for each control mechanism may be formed in a common cylindrical sleeve which has a central bore for receiving the spools of the control mechanisms. The sleeve may be driven from a suitable actuator, such as a stepper motor, such that the sleeve can be rotated in order to set the desired positions of the filler members. Each spool is then axially slidable within the sleeve in response to the position of its associated filler member such that relative axial movement of the spool further varies the venting of the orifices.

DESCRIPTION OF THE DRAWINGS

The invention will now be described, by way of example, with reference to the accompanying drawings, in which.

MODE OF CARRYING OUT THE INVENTION

Figure 1:
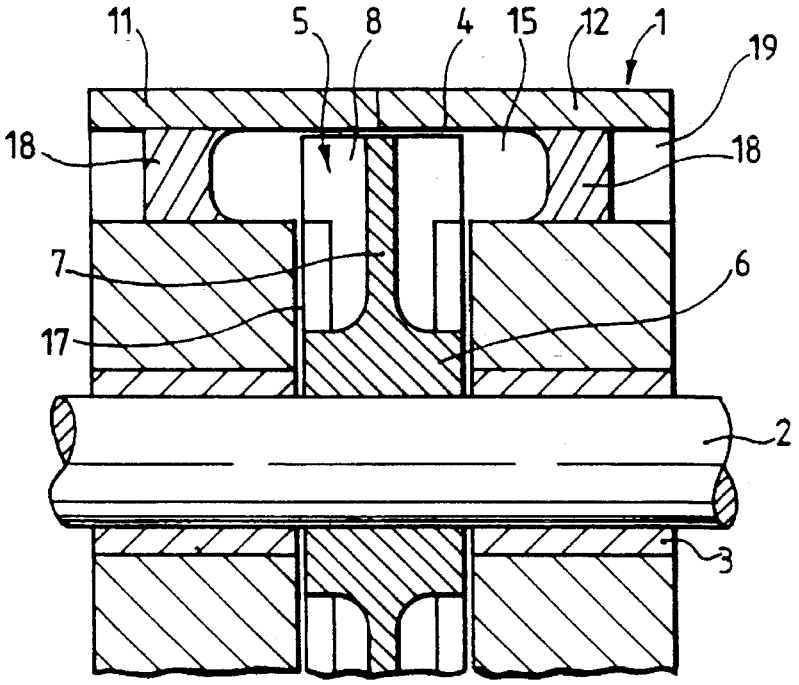
FIG. 1 is a section through a regenerative pump according to one embodiment of the invention.
Figure 2:
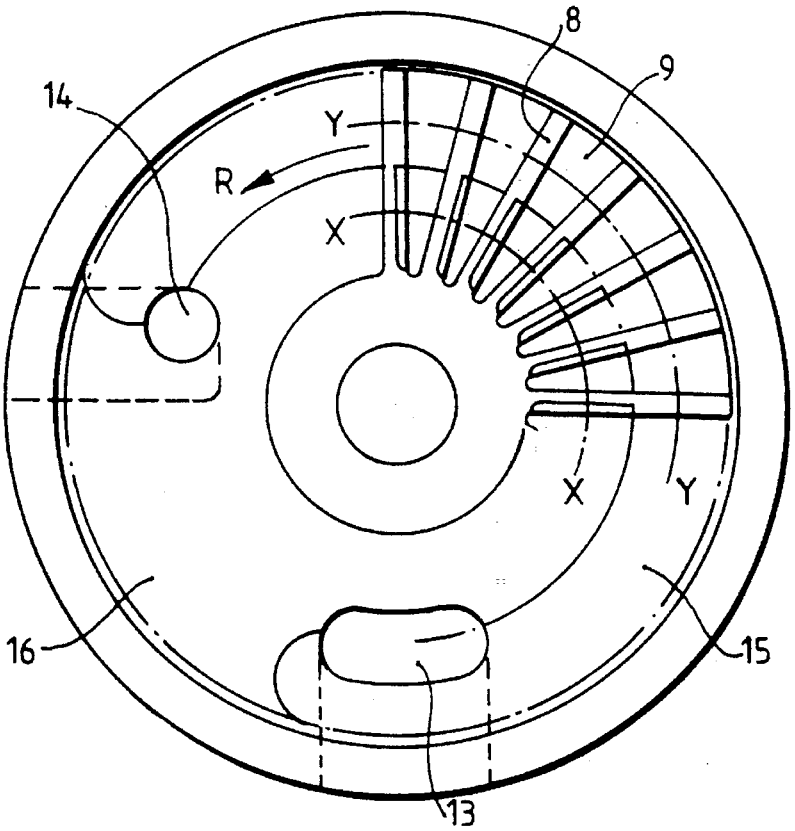
FIG. 2 is a side elevation of the regenerative pump of FIG. 1.

The regenerative pump illustrated in FIGS. 1 and 2 comprises a housing 1 that rotatably supports a shaft 2 in bearings 3 and defines a cylindrical chamber 4 that receives an impeller 5 mounted on the shaft 2. The impeller 5 comprises a hub 6 and a ring 7 that extends radially outwards from the hub 6 and carries a set of blades 8 on both sides that extend laterally and radially of the ring 7. The blades 8 are formed integrally with the hub 6 and ring 7 and conform to a cylindrical profile at their outer periphery to be received as a close fit within the chamber 4.

The blades 8 on each side of the ring 7 extend away from the ring in the direction of rotation R of the impeller. The spaces 9 between the blades 8 define a ring of cells each side of the impeller.

The housing 1 is formed in two sections 11,12 that meet on the central plane of the impeller 5. A pump inlet 13 is formed in the side wall of each section 11,12 and the inlets open into the chamber 4 opposite one another and adjacent to the middle region of the cells 9. A pump outlet 14 is formed in the side wall of each section 11,12 of the housing and the outlets open into the chamber 4 opposite one another and adjacent to the middle region of the cells 9 but in a location which is offset angularly in the direction of rotation R of the impeller by approximately 225 degrees from the pump inlets 13, as shown in FIG. 2.

A side channel 15 is formed in the side wall of each section 11,12 of the housing so as to open into the chamber 4. This channel 15 extends alongside the outer portion of the impeller over a considerable angle between the pump inlet 13 and the pump outlet 14. The uninterrupted portion 16 of the side wall of the housing between the closed ends of the side channel acts as a stripper which limits the direct flow of fluid from the pump outlet 14 to the pump inlet 13 as will become apparent in the following description of the operation of the pump.

In operation, the impeller 5 rotates in the direction R and serves to produce a radially outward flow of fluid in the cells 9 through centrifugal action. At the outer periphery of the rotor, the fluid is directed laterally outwards into the side channels 15 where it is recirculated inwards back into the cells 9. This recirculating action continues along the whole length of each side channel 15 as the impeller rotates, thereby increasing the pressure of the fluid until it is discharged through the pump outlet 14. It will be appreciated that fluid is carried in the cells 9 across the stripper 16 between the closed ends of the side channel 15, but the close proximity of the outer edges 17 of the blades 8 to the inner surface of the stripper limits the flow of fluid directly therebetween from the pump outlet 14 back to the pump inlet 13.

Each side channel 15, as shown in FIG. 1, has a base defined by a moveable wall 18 which is mounted in a recess 19 in the housing 1 so as to be moveable axially to vary the depth of the channel. The wall 18 extends the full circumferential length of the side channel 15 so that it remains a uniform depth throughout its length. Actuator means (not shown), which may be hydraulic, electric or mechanical, is provided to vary the axial positions of each wall 18 in its respective recess 19, both walls 18 preferably being adjusted simultaneously to maintain the depth of both side channels 15 equal.

Figure 4:
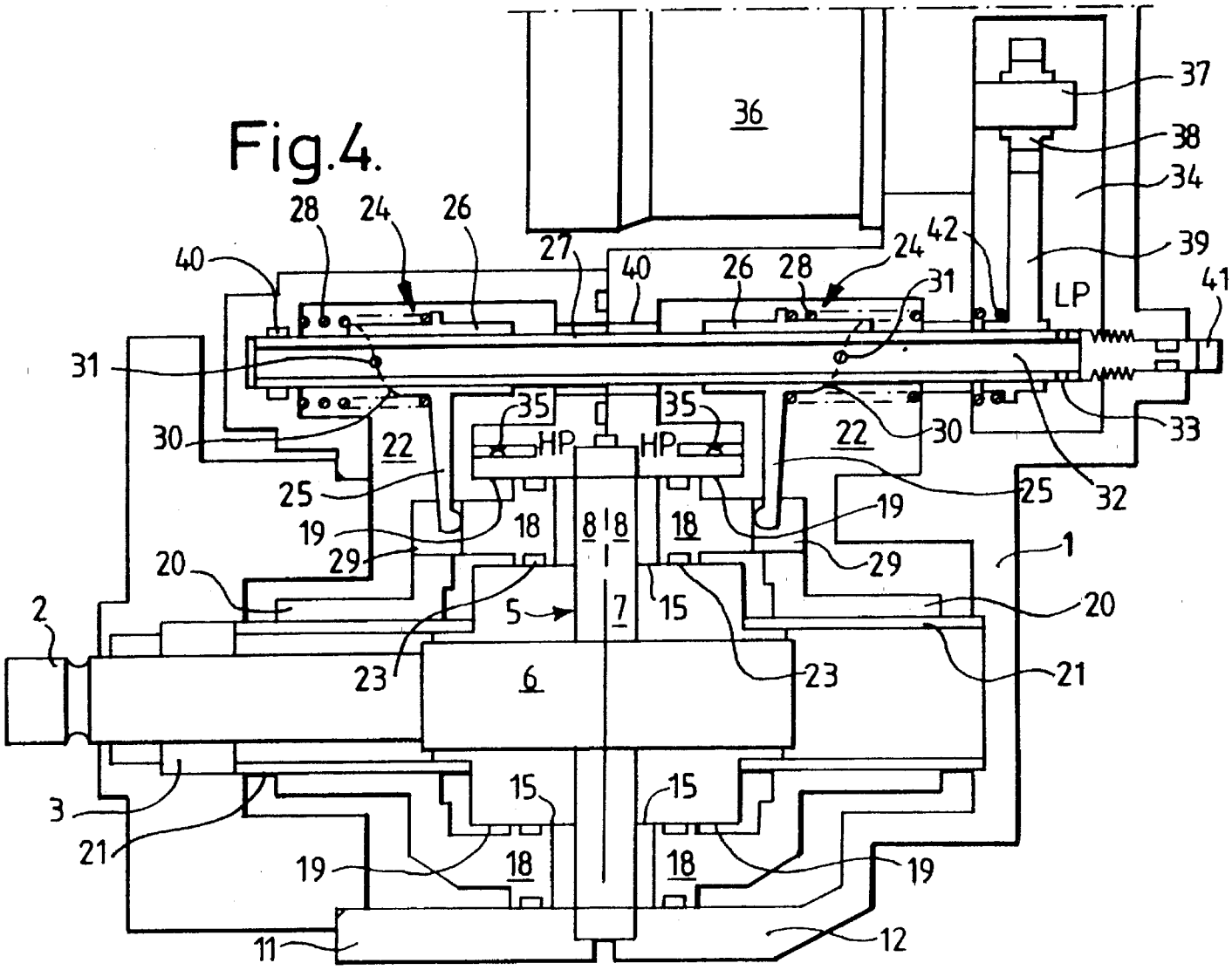
FIG. 4 is a section through the regenerative pump shown in FIG. 1 and showing the control system thereof.

FIG. 4 illustrates a pump similar to that shown in FIG. 1.

In the embodiment shown in FIG. 4, each wall 18 extends the full circumferential length of the associated side channel 15 and is formed with a central hub 20 at its rear by which it is slideably supported on a bearing 21 coaxial with the shaft 2 of the impeller so that it is maintained throughout its length at a uniform depth in the recess 19. The recess 19 opens at the rear into a fluid chamber 22, and seals 23 are fitted in peripheral grooves of the wall 18 so as to form a fluid seal in the recess 19 between the side channel 15 on one side of the wall 18 and the chamber 22 on the other side. The wall 18 is therefore adapted to act as a piston, its axial position being controlled by the setting of a hydraulic servo-control mechanism that balances the fluid pressures acting both sides of the wall. Similar servo-control mechanisms adjust both walls 18 simultaneously so as to maintain the depth of both side channels 15 equal.

It will be appreciated that the fluid pressure within the side channel 15 increases from a low pressure at the pump inlet 13 to a high pressure at the pump outlet 14. The total fluid force is therefore the integral of the pressure over the whole area of the wall 18, and will correspond to an average pressure between that of the inlet and outlet pressures. The pressure in chamber 22 required to balance the forces on the wall 18 therefore corresponds substantially to this average pressure.

The servo-control mechanism for each wall 18 comprises a servo-control valve 24 which is located within the chamber 22 and has a mechanical feedback connection 25 from the wall 18. Each valve 24 comprises a sleeve 26 and both sleeves 26 are mounted on a common servo-shaft 27 that extends the width of the pump housing parallel to the impeller shaft 2. Each sleeve 26 is free to slide longitudinally on servo-shaft 27 and is spring-loaded towards the centre plane of the pump by a compression spring 28. The feedback connection 25 consists of a finger that extends radially from the sleeve 26 and engages at its tip in a notch 29 formed in the rear of the wall 18. Cooperation of the tip of the finger 2.5 with the sides of the notch 29 serves to prevent rotation of the sleeve on the shaft 27. The shaft 27 is, however, rotatable within the pump housing to adjust the axial setting of the walls 18, as will be described hereafter.

The rear edge 30 of the sleeve 26 cooperates with a fluid flow control orifice 31 in the shaft 27 which communicates in turn via a central bore 32 in the shaft and further orifices 33 at the outer end of the shaft, with a low pressure chamber 34 connected to the pump inlet 13. Under stable operating conditions, the net forces acting on both sides of the wall 18 balance one another. A restrictor 35 is connected between the high pressure outlet end of the side channel 15 and the chamber 22, to allow fluid flow between the two. The control orifice 31 is partially covered and partially uncovered by the rear edge 30 of the sleeve 26. There is therefore a flow of fluid from the high pressure end of the side channel 15, through the restrictor 35 into the chamber 22, and in through the control orifice 31, shaft 26 and orifice 33 to the low pressure chamber 34. The pressure drop across the restrictor balances the fluid forces and the small spring force 28 acting upon the wall 18 so that the wall remains stationary under steady state conditions.

This stable condition is upset by rotation of the servo-shaft 27 when it is desired to adjust the depth of the side channels 15. The rear edge 30 of each sleeve 26 is inclined relative to the radial plane of the servo-shaft 27 in the region of the control orifice 31 so that rotation of the shaft 27 will serve to move the control orifice 31 across the edge 30 to cover or uncover more of the orifice 31. Uncovering the orifice 31 will vent more fluid from the chamber 22 via orifice 31, bore 32 and orifices 33 to the low pressure chamber 34. As a consequence, the wall 18 will be moved axially rearwards by the pressure in the side channel 15, and this movement will be transferred through the feedback finger 25 to the sleeve 26 which thus moves to partially cover the control orifice 31 again, thereby to restore a stable condition with the wall 18 in a new axial position corresponding to the angular setting of the servo-shaft 27. Thus, the axial position of wall 18 follows the demanded position defined by the rotation of the stepper motor and the inclination of edge 30.

It will be appreciated that if the servo-shaft 27 is rotated to cause the control orifice 31 to be covered more by the rear edge 30 of the sleeve 26, then there will be a build-up of pressure in the chamber 22 from the side channels 15, and as a result, the wall 18 will be moved forwards and the sleeve 26 will follow this movement by virtue of the spring 28 and feedback finger 25 until the control orifice 31 is again only partially covered by the rear edge 30 of the sleeve 26.

Control of the angular setting of the servo-shaft 27 is effected by an electric stepper motor 36 which is mounted on the pump housing 1 and is coupled via a drive shaft 37 and reduction spur gears 38,39 to the servo-shaft 27. These spur gears 38,39 are located within the low pressure chamber 34.

The rapid feedback response and stiff characteristic of the follow-up servo-control valves 24 combined with the good control characteristics of the stepper motor 36, produces a compact, relatively simple control mechanism.

It will be appreciated that the two servo-control mechanisms for each wall 18 are arranged symmetrically about the central radial plane of the pump impeller 5 so that both walls 18 are adjusted simultaneously by rotation of the servo-shaft 27 by the stepper motor. In order to ensure that the depths of both side channels 15 defined by the axial positions of the side walls 18 are equal, the servo-shaft 27 is axially adjustable in its bearings 40 by a screw adjuster 41 at that end adjacent to the low pressure chamber 34. A coiled compression spring 42 within the low pressure chamber 34 acts against the spur gear 39 fastened to the servo-shaft 27 so as to urge the end of the latter into engagement with the screw adjuster 41.

The rapid response and stiff nature of the follow-up servo mechanism ensures that the two channel depths stay synchronised so that there is no out-of-balance axial force on the impeller.

Figure 3:
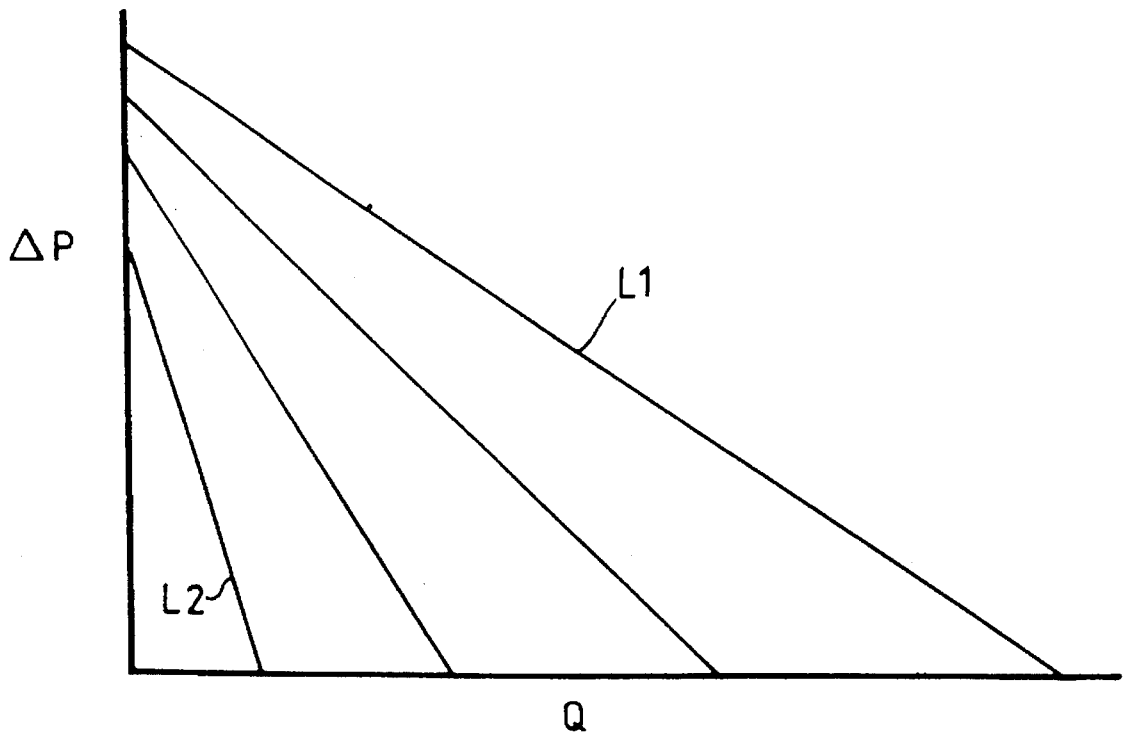
FIG. 3 is a graph of pressure difference $\Delta p$ across the pump against the flow coefficient Q.

The servo-control mechanism may, in a typical application, vary the position of the walls 18 in accordance with the pressure drop across a fuel metering valve connected in circuit with the pump. Typically, the fuel metering valve may comprise a servo-operated piston, and the servo-control mechanism may operate to reduce the channel cross-section, and thereby reduce the pressure rise and output fuel flow as the metered fuel demand reduces characteristic of the pump would be as illustrated in FIG. 3, which shows the pressure rise $\Delta p$ against flow coefficient Q at a given pump speed for different settings of the walls 18. Line L1 shows the characteristic when the channels 15 have a maximum cross-section, and line L2 shows the characteristic when the channels 15 have a minimum cross-section. The reduced cross-section reduces the pump displacement and thereby reduces the fuel flow Q at zero pressure rise $\Delta p$. The reduced cross-section also changes the aspect ratio of the side channels 15 which causes a reduced pressure rise Δp at zero flow. Stops may be provided to determine the maximum and minimum section position at the walls 18.

Figure 5:
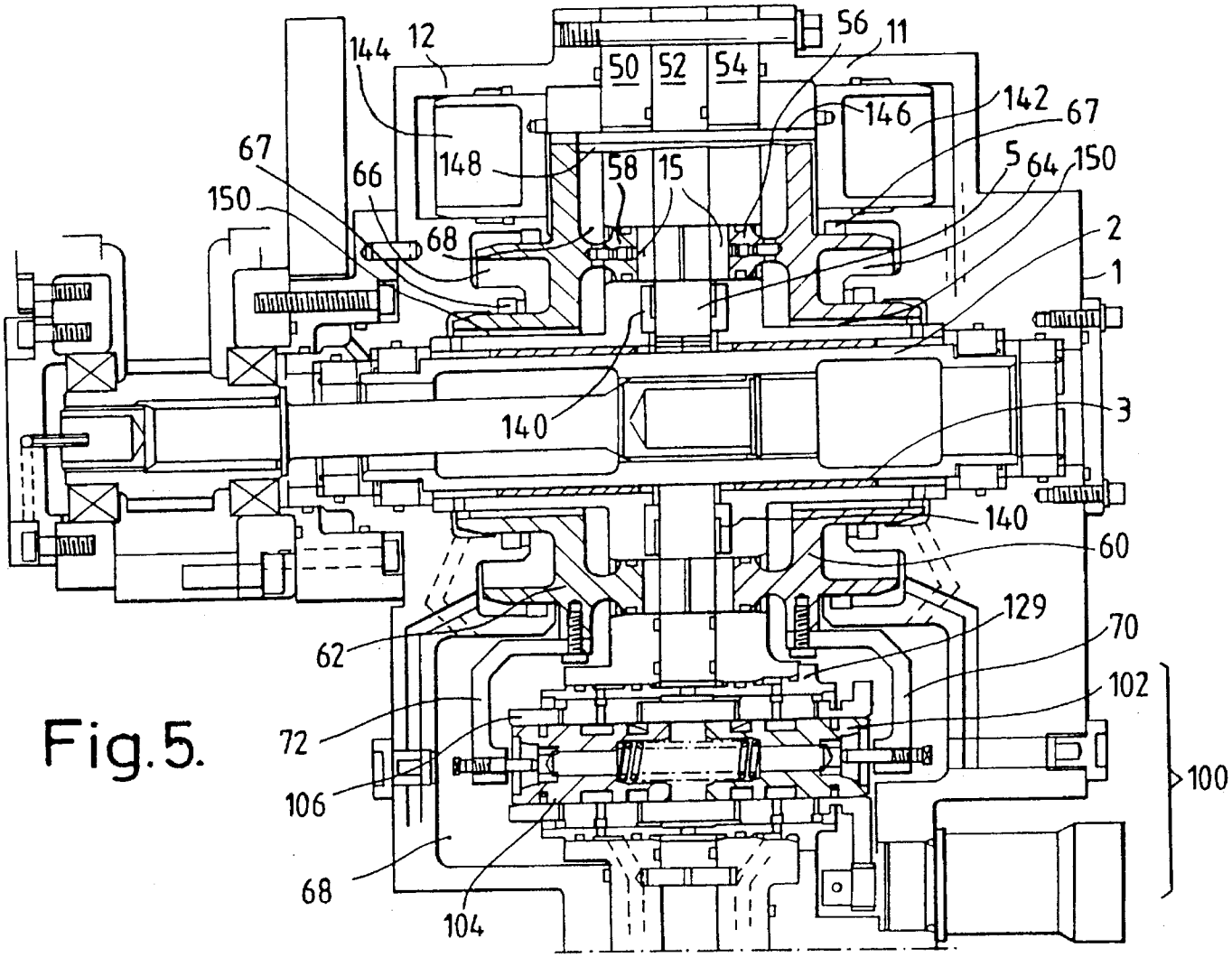
FIG. 5 is a section through a regenerative pump constituting a further embodiment of the invention.

FIG. 5 is a cross sectional illustration of another regenerative pump constituting an embodiment of the present invention. As with the previously described embodiments, a housing 1 is formed of two sections 11 and 12 and the housing 1 rotatably supports a shaft 2 in bearings 3. An impeller 5 of the type previously described has 20 chevron blades and sits within a cylindrical chamber, also as previously described.

The sections of the housing 11 and 12 are separated from each other by first, second and third spacers 50,52 and 54, respectively. The first and third spacers 50 and 54 have elongate recesses formed in them that follow a curved path so as to define the side channels 15.

First and second "C" shaped members (when viewed in a plane parallel to the impeller) 56 and 58, respectively, are moveably mounted in substantially fluid sealed engagement within the side channels 15. The "C" shaped members 56 and 58 are directly connected to associated servo pistons 60 and 62, respectively. The servo pistons 60 and 62 are in moving substantially fluid sealed engagement with annular or part annular recesses formed in the housings 11 and 12, thereby defining first and second variable volume chambers 64 and 66. The volume of fluid within the chambers can be controlled by a position control mechanism 100 so as to control the positions of the servo pistons 60 and 62, and hence control the depth of the side channels. The servo pistons 60 and 62 are located within a working chamber 68 which is connected to a low pressure return line (not shown). Thus, any leakage from the side channels 15 past the "C" shaped members 56 and 58 is drained to low pressure which does not result in a deterioration in the performance of the servo piston position control. It should be noted that whilst seals provided on the "C" shaped members must also follow the "C" shape and consequently are likely to be relatively leaky, the seals formed at the servo pistons 60 and 62 form very good seals since the servo pistons are not required to be "C" shaped and are in fact annular. Thus, the seals 67 are in effect large "O" ring seals.

The positions of the first and second servo pistons 60 and 62 are fed back to the position control mechanism by first and second arms 70 and 72, respectively.

Figure 6:
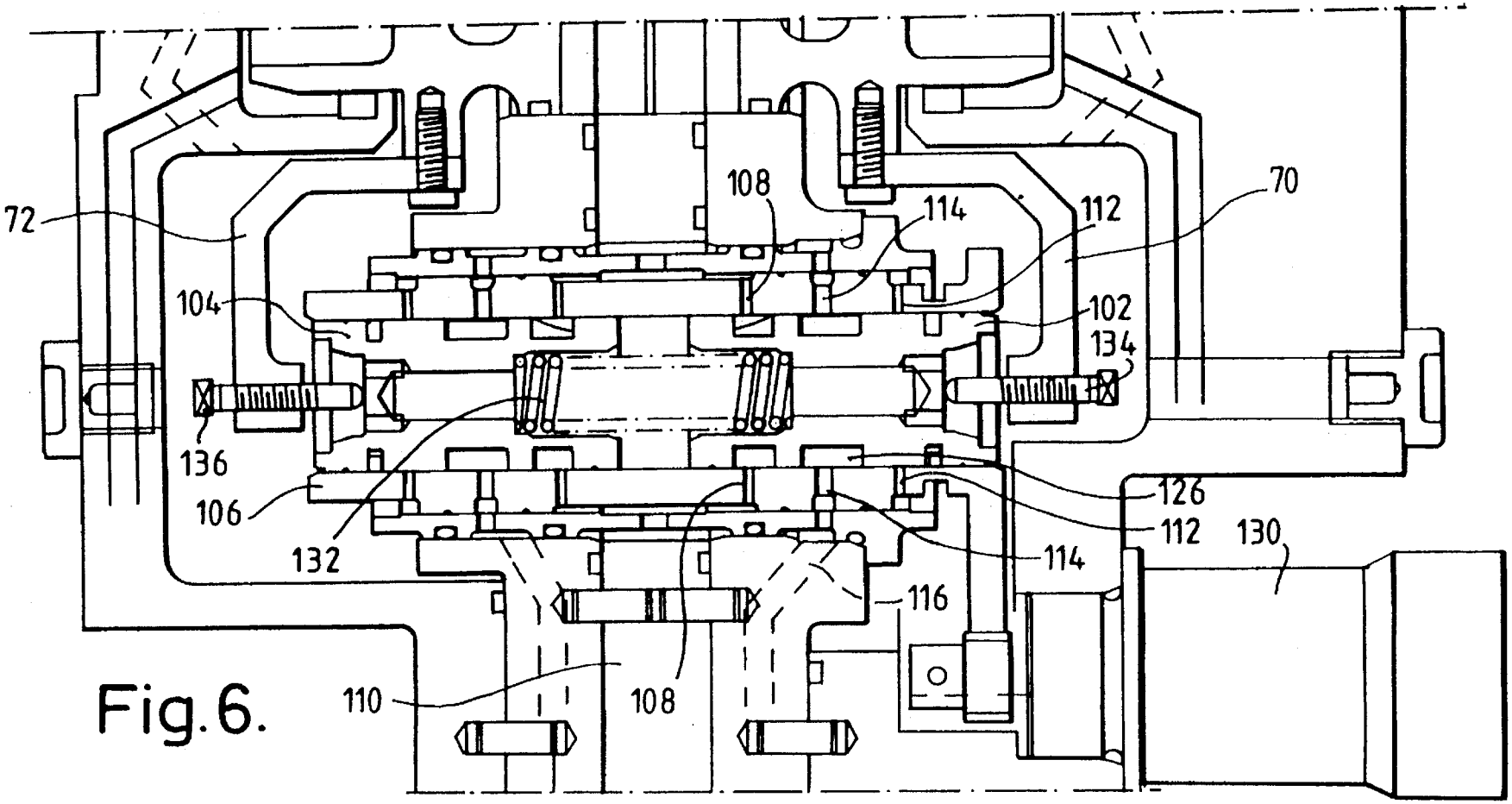
FIG. 6 shows the control mechanism of the pump illustrated in FIG. 5 in greater detail.

The control mechanism comprises first and second spools 102 and 104 axially slidable within a sleeve 106. The sleeve 106 has a plurality of ports formed therein (FIG. 6). The sleeve has twelve ports associated with each of the spools. Considering the first spool 102 and the portion of the sleeve 106 associated therewith, the sleeve has four ports 108 in fluid flow communication with high pressure supply line 110. There are also four ports 112 which are in fluid flow communication with the working chamber 68 (which drains to low pressure). A further four servo ports 114 are in fluid flow communication with the first variable volume chamber 64 via a channel 116 formed in the housing 11. It will be appreciated that the number of ports is a design choice and fewer or more ports may be provided.

Figure 7:
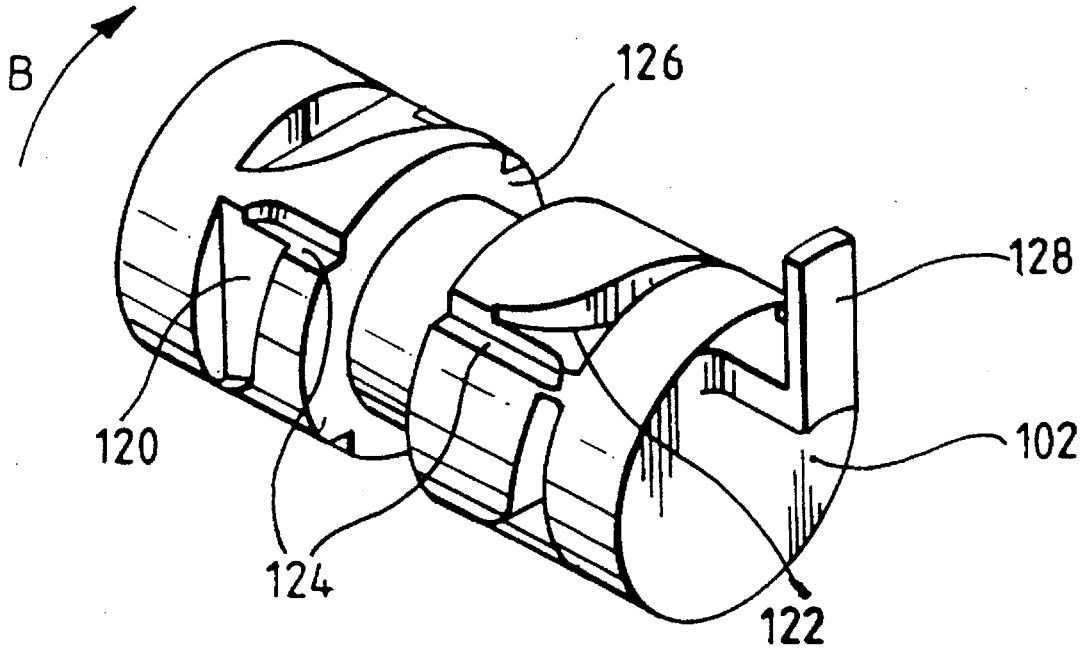
FIG. 7 illustrates a spool of the control mechanism.

The spool 102 has a plurality of recesses formed therein, as shown in FIG. 7. Each recess is, in plan view, substantially shaped like a triangle (albeit a right angled triangle with a curved hypotenuse). The recesses 120 in the vicinity of the ports 108 are formed in the opposite sense to the recesses 122 in the vicinity of the ports 1121 Thus, in the arrangement shown in FIG. 7, the recesses 120 in the vicinity of the high pressure port 108 point in an anti-clockwise sense, whereas the recesses 122 in the vicinity of the low pressure port point in a clockwise sense.

Each recess is connected via a respective channel 124 to an annular channel 126 formed at a wasted portion of the spool 102. The spool also carries a radially projecting lug 128 which engages in a channel (not shown) formed in an outer sleeve 129 which is fixed with respect to the housing 11 so as to prevent the spool 102 from rotating while permitting the spool to undergo translational movement along its axis.

A servo motor 130 is provided to rotatably drive the sleeve 106. Suppose that it is desired to decrease the flow from the pump. The servo motor 130 (such as a stepper motor) is controlled to rotate the sleeve 106 such that the high pressure ports 108 open more into the recesses 120 (i.e. the sleeve is rotated in the direction of arrow B of FIG. 7) and the low pressure ports 112 experience a more constricted flow path via the recesses 122. The ports form a pressure divider and consequently the servo pressure in the channel 126 rises and the increased pressure is provided to the first variable volume chamber 64 via the servo ports 114. This increase in pressure causes the servo piston 60 to move towards the impeller 5 thereby reducing the volume of the side channel 15.

The motion of the servo piston 60 is fed back to the spool 102 via the arm 70. Thus, the spool 102 is moved to the left as viewed in FIG. 6. This causes the recesses 120 and 122 to move with respect to their respective ports in the sleeve, thereby reducing the flow from the high pressure fuel supply and increasing the flow to the low pressure fuel supply. This causes a drop in servo pressure thereby varying the fluid pressure in the variable volume chamber 64.

An equivalent arrangement is provided for the second spool 106. The spools 104 and 106 are biased into contact with their respective feedback arms 70 and 72 by a compression spring 132 located between the spools and in a recess that is in fluid flow communication with the working chamber 68 so as to prevent hydraulic locking of the spools occurring as a result of fuel leakage from the ports 108,112 and 114.

As before, screw adjusters 134 and 136 provide fine adjustment between the feedback arms and their associated spools.

The control system provides a rapid response as both the orifices to high pressure and to low pressure are variable.

In use, the rotor is axially balanced in the steady state. However, transient operating conditions may result in axial forces becoming unbalanced. In order to accommodate this, carbon thrust faces 140 (as shown in FIG. 5) are provided that bear against the impeller 5. Each thrust face has lubrication grooves (not shown) formed therein.

The pressure within the side channels 15 increases from the inlet towards the outlet thereof. This gives rise to forces tending to twist the "C" shaped members 56 and 58 within the side channels. This twist can be reduced or removed by the provision of balance pistons 1.42 and 144 (FIG. 5) which are connected via rods 146 and 148 to the servo piston on the opposing side of the impeller. The balance pistons are positioned adjacent the inlet regions of the side channels and are supplied with fuel from the high pressure outlet of the pump.

At equilibrium, the sum of the force supplied via the balance piston and the forces within the side channel equals the servo force. The forces are arranged such that no tilting of the "C" shaped members occurs.

The servo pistons are supported on side cheek bearings 150 which take up a rotational loading force on the "C" shaped members due to the pressure gradient occurring along the side channel.

In an alternative embodiment, the base of the side channel 15 may be fixed, and instead, a side wall of the channel 15 formed as a moveable wall which is mounted to be moved radially to vary the width of the channel throughout its length.

The arrangement described may also be used to control the so-called helicotorroidal pump of the type disclosed in GB-2260368.

I claim:

1. A regenerative pump, comprising a housing defining a cavity having a fluid inlet and fluid outlet, and a channel extending between said fluid inlet and said fluid outlet, an impeller rotatably mounted within said cavity within the housing and having a plurality of vanes spaced angularly around the impeller axis and opening into said channel formed in the housing and a stripper block located between the inlet and the outlet to restrict direct flow of fluid between the outlet and inlet, in which said impeller is located in a central portion of said cavity, and first and second filler members define walls of the channel, are provided adjacent opposing faces of said impeller and are movable within the channel so as to vary the cross-section of said channel as measured in a first plane containing the axis of rotation of the impeller.

2. A pump as claimed in claim 1, in which said channel is formed of first and second side channels located on either side of said impeller and which deliver fluid to a common pump output.

3. A pump as claimed in claim 1, further comprising actuators for moving said first and second filler members in accordance one of with the required pump characteristic and output.

4. A pump as claimed in claim 3, in which said actuators are hydraulic actuators.

5. A pump as claimed in claim 3, in which each actuator comprises a variable volume chamber defined in part by a rear surface of a filler member,the chamber acting as a cylinder and the filler member acting as a piston within the cylinder.

6. A pump as claimed in claim 3, in which each actuator comprises a piston and cylinder arrangement which is connected to the associated filler member.

7. A pump as claimed in claim 4, in which each actuator is associated with respective first and second flow restrictors connected in series between a source of fluid at high pressure and a low pressure return for deriving fluid pressure for controlling said actuator.

8. A pump as claimed in claim 7, in which one flow restrictor comprises at least one fixed orifice and the other flow restrictor comprises at least variable orifice whose venting is controlled in order to control a servo pressure derived intermediate said first and second flow restrictors.

9. A pump as claimed in claim 7, in which said first and second flow restrictors comprise variable orifices arranged such that motion of a control element to increase the amount of venting from one of the flow restrictors decreases the amount of venting from the other one of the flow restrictors.

10. A pump as claimed in claim 7, in which said variable orifices comprise a spool having tapered channels formed in a surface thereof such that relative motion of the spool with respect to orifices varies the servo pressure.

11. A pump as claimed in claim 3, in which control mechanisms for each of the actuators are arranged together such that each mechanism receives a common control input and is arranged to independently perform closed loop control of the position of the associated actuator.

12. A pump as claimed in claim 11, in which said orifices for each control mechanism are formed in a common cylindrical sleeve which has a central bore for receiving spools of the control mechanisms.

13. A pump as claimed in claim 12, in which each spool is independently slidable within said sleeve such that relative axial movement of each spool varies the venting of the associated first and second orifices.

14. A pump as claimed in claim 2, in which each channel has a volume and the volumes of the side channels are varied simultaneously and are controlled to be substantially equal.

15. A pump as claimed in claim 1, in which the filler members are moved axially relative to the radial plane of the impeller to vary an axial depth of the channel.

16. A pump as claimed in claim 1, in which the filler members form movable side walls of the channel which are moved radially to vary the width of the channel throughout its length.

* * * * *